US005474879A

United States Patent [19]

Fitterman et al.

[11] Patent Number: 5,474,879

[45] Date of Patent: Dec. 12, 1995

[54] RADIOGRAPHIC FILM DEVELOPERS CONTAINING ASCORBIC ACID AND THIOETHER DEVELOPMENT ACCELERATORS

[75] Inventors: Alan S. Fitterman, Rochester; Joan F. Rachel, Penfield, both of N.Y.

[73] Assignee: Eastman Kodak Company, Rochester, N.Y.

[21] Appl. No.: 380,781

[22] Filed: Jan. 30, 1995

[51] Int. Cl.[6] ..... G03C 5/305

[52] U.S. Cl. ..... 430/487; 430/440; 430/445; 430/446; 430/480; 430/483; 430/486

[58] Field of Search ..... 430/440, 445, 430/446, 480, 483, 486, 487

[56] References Cited

U.S. PATENT DOCUMENTS

| | | | |
|---|---|---|---|
| 3,615,528 | 10/1971 | Huckstadt et al. | 430/486 |
| 4,960,683 | 10/1990 | Okazaki et al. | 430/445 |
| 5,098,819 | 3/1992 | Knapp | 430/436 |
| 5,147,767 | 9/1992 | Knapp | 430/435 |
| 5,344,750 | 9/1994 | Fujimoto et al. | 430/487 |

FOREIGN PATENT DOCUMENTS 1129085 10/1968 United Kingdom .

OTHER PUBLICATIONS

Development Accelerators in Photographic Processing Chemistry, Focal Press, London 1975.

*Primary Examiner*—Hoa Van Le

*Attorney, Agent, or Firm*—John R. Everett

[57] ABSTRACT

An alkaline, hydroquinone free, aqueous black-and-white radiographic developer comprising (a) an ascorbic acid developing agent;

(b) a 3-pyrazolidone auxiliary developing agent;

(c) an organic antifoggant;

(d) a sulfite antioxidant;

(e) a buffer;

(f) a sequestering agent; and (g) A development accelerator selected from formulas I and II as follows:

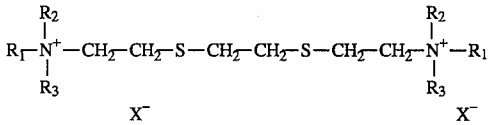

(I)

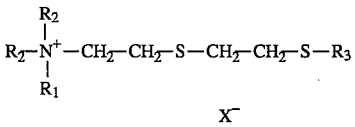

(II)

wherein $R_1$, $R_2$, and $R_3$ represent alkyl of 1 to 8 carbon atoms or $R_1$, $R_2$, and $R_3$ taken together with N atom to which they are attached form a 6 or 7 membered ring and X represents a tosylate ion, halide, or $BF_4^-$.

12 Claims, No Drawings

RADIOGRAPHIC FILM DEVELOPERS CONTAINING ASCORBIC ACID AND THIOETHER DEVELOPMENT ACCELERATORS

FIELD OF THE INVENTION

This invention relates to photography, particularly developers for radiographic film.

BACKGROUND OF THE INVENTION

Radiographic developer compositions are well-known in the art. The processing of silver halide photographic materials is performed by a multiple step sequence consisting of development, stopping, fixing and washing steps.

The development step is conventionally undertaken with an aqueous alkaline developer composition containing a developer such as hydroquinone and/or other well-known developing agents.

More specifically, the exposure of a silver halide emulsion to radiation to which the emulsion is sensitized produced a latent image in the silver halide grains of the emulsion. The latent image is developed by immersion of the exposed emulsion in an aqueous developing solution that contains a reducing agent (or developer). The hydroquinone or other suitable developer material serves to reduce the exposed silver halide grains to yield the developed photographic image.

Exemplary hydroquinone-based developer compositions are disclosed in, for example, U.S. Pat. Nos. 2,893,865; 3,733,199; 3,865,591; 4,046,571; 4,205,124; 4,756,990; and 4,816,384. Normally, these compositions contain relatively high levels of sulfite-based components.

Developers containing ascorbic acid and ascorbic derivatives are known from publications such as U.S. Pat. Nos. 5,090,819 and 5,147,767. These developers are subject to oxidation. The oxidation is probably due to the catalytic effect of metal ions (G. Haist "Modern Photographic Processing", John Wiley and Sons, New York, 1979.) Typically, given adequate development times, developer formulations can be made, that under ideal conditions that minimize oxidation, result in sensitometry comparable to hydroquinone-based developer formulas. However to obtain adequate upper scale density longer development times are necessary.

Films developed with a ascorbic acid developers, under rapid processing conditions such as Kodak's kwik process (45 second process cycle with development times under 15 seconds) result in developed films having lower speed, contrast and Dmax.

Development accelerators are disclosed in "Photographic Processing Chemistry", Focal Press, London, 1975). The disclosed accelerators include certain cationic wetting agents and thio compounds. Cationic wetting agents (quaternary ammonium compounds) only produce the acceleration effect on developing agents that function as negatively charged species such as developers based on hydroquinone.

Aliphatic thioethers appear to be the most useful thio compounds, especially those with acid amide groups disclosed in British Patent 1,129,085; 1965. However these compounds adversely affect developers containing ascorbic acid in that at levels necessary to obtain adequate speed or high Dmin is observed.

SUMMARY OF THE INVENTION

The present invention provides an alkaline, hydroquinone free, aqueous black-and-white radiographic developer comprising (a) an ascorbic acid developing agent;

(b) a 3-pyrazolidone auxiliary developing agent;

(c) an organic antifoggant;

(d) a sulfite antioxidant;

(e) a buffer;

(f) a sequestering agent; and (g) A development accelerator selected from formulas I and II as follows:

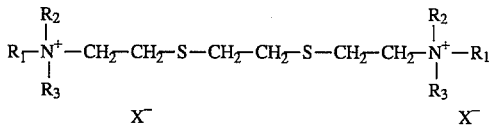

(I)

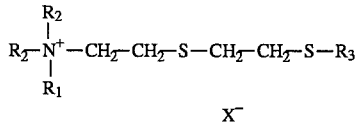

(II)

wherein $R_1$, $R_2$, and $R_3$ represent alkyl of 1 to 8 carbon atoms or $R_1$, $R_2$, and $R_3$ taken together with N atom to which they are attached to form a 6 or 7 membered ring and X represents a tosylate ion, halide, or $BF_4^-$.

This ascorbic acid containing developer achieves sensitometry comparable to hydroquinone-based developers under rapid processing conditions.

DETAILS OF THE INVENTION

The radiographic developer of the invention comprises: (a) an ascorbic acid developing agent; (b) a 3-pyrazolidone auxiliary developing agent; (c) an organic antifoggant; (d) a sulfite antioxidant; (e) a buffer; (f) a sequestering agent; and (g) a development accelerator as previously defined.

Suitable developing agents include ascorbic acid, L-ascorbic acid, D-ascorbic acid, L-erythroascorbic acid, D-glucoascorbic acid, 6-desoxy-L-ascorbic acid, L-rhamnoascorbic acid, D-glucoheptoascorbic acid, D-glucoheptoascorbic acid, imino-L-erythroascorbic acid, imino-D-glucoascorbic acid, imino-6-desoxy-L-ascorbic acid, imino-D-glucoheptoascorbic acid, sodium isoascorbate, L-glycoascorbic acid, D-galactoascorbic acid, L-araboascorbic acid, sorboascorbic acid, sodium ascorbate and the like. The concentration of ascorbic acid type developing agents is from 0.8 to 4 weight percent of the developer composition.

Sequestering agents are used in radiographic developers to counteract the effect of soluble salts or trace metal impurities that may be present. Such impurities may originate in the developer itself or may be introduced from the environment during use of the developer solution. Common impurities are calcium, iron, and copper ions. Calcium can precipitate in the developer resulting in particulate contamination. Iron and copper can catalyze the oxidation of hydroquinone or the like, resulting in a degradation of developer stability. These effects are particularly undesirable in developers used in radiography.

Sequestering agents typically function by forming stable complexes with metal ion impurities; thus reducing the concentration of free metal ion impurities to acceptable levels. These complexes are classified in *Photographic Processing Chemistry*, L.F.A. Mason, Focal Press, London, (1975) pp. 55–67, by structure into three main groups: complex phosphates, hydroxy acids, and nitrogenous carboxylic acids. Concentration of sequestering agents are typically 0.1 to 1.0 weight percent of the developer composition.

The auxiliary developing agent consists of one or more compounds, such as 3-pyrazolidinones or aminophenols which provide a superadditive developing effect in combination with the hydroquinone agent. Suitable compounds include: 4-hydroxymethyl-4-methyl-1-phenyl-3-pyrazolidinone, 1-phenyl-3-pyrazolidinone, 1-phenyl-4-phenyl-3-pyrazolidinone, 1-phenyl-4,4 -dimethyl-3-pyrazolidinone, 1-phenyl-4-methyl-3 -pyrazolidinone, 1-phenyl-5-methyl-3-pyrazolidinone, 4 -methyl-1-phenyl-3-pyrazolidinone, 4,4'-dimethyl-1 -phenyl-3-pyrazolidinone, o-aminophenol, p-aminophenol, N-methyl-p-aminophenol, N-methyl-o-aminophenol, and 2,4-diaminophenol. A suitable range of concentrations for the auxiliary developing agent is 0.1 to 1.0 weight percent of the developer composition.

The organic antifoggant is a compound or mixture of compounds which controls the gross fog (GF) appearance in the processed materials. Suitable antifoggants include benzimidazole-, benzotriazole-, mercaptoazole-, indazole-, and mercaptothiadiazole-type antifoggants. Suitable compounds include: 5 -nitroindazole, 5-p-nitrobenzoylaminoindazole, 1-methyl-5-nitroindazole, 6-nitroindazole, 3-methyl-5 -nitroindazole, 5-nitrobenzimidazole, 2-isopropyl-5 -nitrobenzimidazole, 5-nitrobenzotriazole, sodium 4-(2 -mercapto-1, 3,4-thiadiazol-2-yl-thio)butanesulfonate, 5 -amino-1,3,4-thiadiazole-2-thiol, 5-methylbenzotriazole, 1-phenyl-5-mercaptotetrazole, and benzotriazole. A suitable range of concentrations for the antifoggant is 0.001 to 0.1 weight percent.

The sulfite antioxidant consists of one or more compounds capable of generating sulfite ion, $SO_3^{2-}$, in aqueous solutions. Such compounds include sulfites, bisulfites, metabisulfites, and aldehyde-bisulfite adducts. The latter compounds constitute both dialdehyde hardener and sulfite antioxidant. Suitable sulfite antioxidants include sodium sulfite, sodium bisulfite, sodium metabisulfite, potassium sulfite, potassium bisulfite, potassium metabisulfite and ammonium metabisulfite. The total amount of sulfite ions supplied by the sulfite antioxidant is greater than 0.05 moles per liter of developer, or more preferably, from 0.1 to 1.25 moles per liter of developer. The molar ratio of sulfite ions to hydroquinone agent is greater than 2:1, or more preferably, from 2.5:1 to 4:1.

The buffer includes a variety of components, most of which have pH related effects. Classes of components include buffering agent, such as carbonates, boric acid, borate salts, and alkanolamines; and alkaline agents, such as KOH, NaOH, LiOH, and sodium and potassium carbonates. The buffering agent, in a currently preferred embodiment of the invention, has a molar ratio relative to the sulfite ions supplied by the sulfite antioxidant of greater than 0.5:1 (moles of buffering agent:moles of sulfite ions), or more preferably from 1:1 to 2:1. The developer of the invention has a preferred pH of from about 9 to 11.

Additional components of the buffer, in particular embodiments of the invention, include dissolving aids, such as polyethylene glycols or polyethylene glycol esters; pH adjusting agents such as organic acids like acetic acid; development accelerators such as pyridiminium compounds, and polyethylene glycols; surface active agents; dispersing agents for eluted silver colloids, such as mercapto compounds; restrainers, such as potassium bromide or sodium bromide; and additional sequestering agents. Examples of additional sequestering agents include aminopolycarboxylic acids like ethylenediaminotetraacetic acid and diethylenetriaminepentaacetic acid, aminopolyphosphonic acids like methylaminophosphonic acid, polyphosphate compounds like sodium hexametaphosphate, α-hydroxycarboxylic acid compounds like lactic acid, dicarboxylic acid compounds like malonic acid, α-ketocarboxylic acid compounds like pyruvic acid, and alkanolamine compounds like diethanolamine.

The developer accelerators should be present in the developer at a concentration of from 0.01 to 0.4 weight percent. Specific examples of the accelerators are presented in the following examples that demonstrate the utility of the developers of the invention. The accelerators can be made by procedures well known in the art such as described in European Patent Application 0458277 A2 and U.S. Pat. No. 3,827,886. In addition to the accelerators disclosed in the examples, other accelerators include:

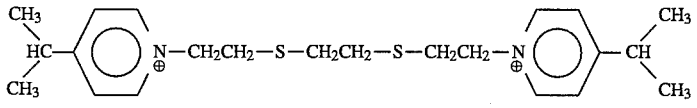

$2X^{\ominus}$
$X^{-}$ = tosylate

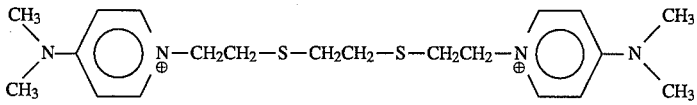

$2X^{\ominus}$
$X^{-}$ = tosylate

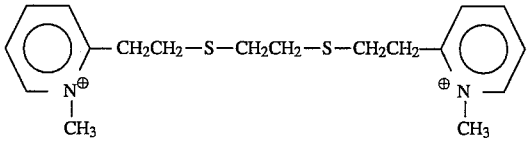

-continued $2X^{\ominus}$
$X^{-}$ = tosylate

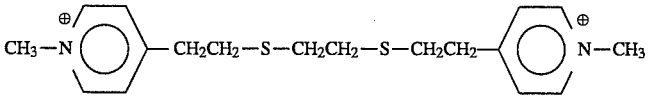

$2X^{\ominus}$
$X^{-}$ = tosylate

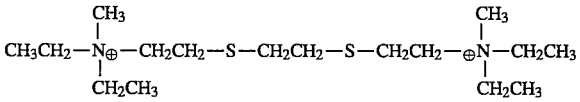

$2X^{\ominus}$
$X^{-}$ = tosylate

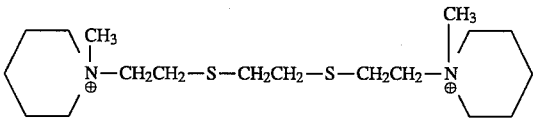

$2X^{\ominus}$
$X^{-}$ = tosylate

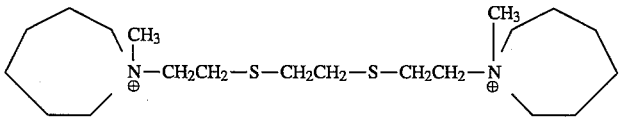

$2X^{\ominus}$
$X^{-}$ = tosylate

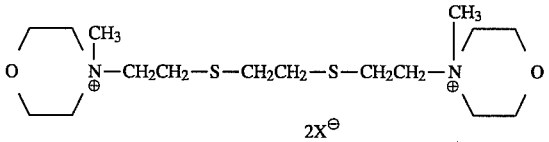

$2X^{\ominus}$
$X^{-}$ = tosylate

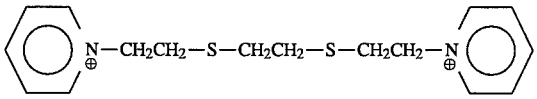

$2X^{\ominus}$
$X = BF_4^{-}$

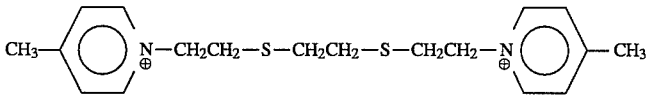

$2X^{\ominus}$ $X = BF_4^{-}, Br^{-},$ 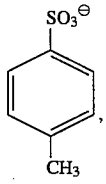 , tosylate

The developer of the invention is prepared by dissolving the ingredients in water and adjusting the pH to the desired value. The developer may also be prepared in a concentrated form and then diluted to a working strength just prior to use. The developer may be prepared in two or more concentrated parts to be combined and diluted with water to the desired strength and placed in the developing tank of an automatic processing machine.

The developer of the present invention is particularly useful when processing is carried out in an automatic processing machine, such as the device described in U.S. Pat. No. 3,545,971. Suitable processing machines are sold by Eastman Kodak Company of Rochester, N.Y., under the trademark "X-OMAT".

Developing temperature and developing time are dependent upon each other and upon the total processing time. In a particular embodiment of the invention, the development temperature is from about 20° to 50° C. and the development time is from 10 seconds to 1.5 minutes.

After development in the developer of the invention, the radiographic material is fixed, washed and dried in a manner well known to those skilled in the art. Any of a variety of fixing solutions, well known to those skilled in the art, can be used. In a particular embodiment of the invention, the fixing solution is an aqueous solution containing thiosulfate ions and ammonium ions, and, optionally, a water-soluble aluminum compound and one or more of the following acids or their salts: tartaric acid, citric acid, gluconic acid, boric acid.

The fixing solution desirably has a pH of from about 3.8 to about 7.0 at 20° C. The water soluble aluminum compound is added if a hardener is desired. Suitable aluminum compounds include aluminum chloride, and aluminum sulfate. A suitable concentration of thiosulfate and ammonium ions in the fixing solution is from about 0.1 to 5 moles per liter. A suitable concentration for the tartaric acid or other acid or salt is at least $5\times10^{-3}$ moles per liter of fixing solution, or more preferably, from $1.5\times10^{-2}$ to $5\times10^{-2}$ moles per liter of fixing solution.

In an automatic processor in which developer is carried over into the fixing solution, it may be desirable to have the initial pH of the fixing solution from about 3.8 to 5.0; unless other provision is made for maintaining the pH of the fixing solution within a suitable range.

The fixing solution may optionally include a preservative such as sulfite or bisulfite, a pH buffering agent such as borate and/or acetate, a pH adjusting agent such as acetic acid and a sequestering agent. Suitable fixing temperatures and times are in the same range as developing temperatures and times.

After fixation, the radiographic material is washed to remove silver salt dissolved by the fixation. Suitable washing temperatures and times are in the same range as fixing and developing temperatures and times.

Radiographic elements to which the invention is applicable utilize silver bromide or silver bromide-iodide. The emulsions can be chemically sensitized by conventional procedures. The radiographic elements can include emulsion stabilizers, fog inhibiting compounds, development accelerators, hardening agents, wetting agents, plasticizers, light screening dyes and other addenda. Characteristics of various hardenable photographic elements are described in U.S. Pat. No. 4,078,932 which is incorporated herein by reference.

The following Examples demonstrate the utility of this invention.

EXAMPLES 1–3

The development accelerators (1 and 2) described below are examples of the 2 classes of accelerators within the scope of the invention. Development accelerator (3) is presented for comparison of choice. All 3 accelerators were tested in the same developer solution presented below in Table I at a concentration of 0.6 mmoles per liter.

TABLE I

| Developer Example | |
|---|---|
| Component | Concentration |
| ascorbic acid | 32 g/l |
| potassium sulfite | 50 g/l |
| potassium carbonate | 100 g/l |
| 4-hydroxymethyl-4-methyl-1-Phenyl-3-pyrazolidone | 3.0 g/l |
| 1-phenyl-5-mercaptotetrazole | 0.05 g/l |
| benzotriazole | 0.2 g/l |
| diethylenetriaminepentaacetic acid | 1.7 g/l |
| potassium bromide | 4.0 g/l |
| accelerator | 0.6 mmoles/l |
| pH | 10.3 |

Sensitometric results were obtained with fresh samples of the developer solutions for 6 different radiographic films commercially available from Eastman Kodak Company. The films tested were T-MAT G/RA film (TMG/RA), T-MAT H/RA film (TMH/RA), T-MAT L/RA film (TML/RA), T-MAT C/RA film (TMC/RA), T-MAT S/RA film (TMS/RA) and Ektascan B/RA film (EB/RA). These are forehardened films. The sensitometric results are presented in Table II.

The film samples were exposed with a sensitometer using a conventional 21 step exposure. The samples were then processed in a Kodak M6RA Processor with a developer temperature of 98 degrees (36.6 degrees Celsius) and an 11 second development time. This is Kodak's kwik process for radiographic film. Conventional density vs. log E curves were evaluated using a densitometer.

Density measurements from the exposure steps are plotted against the relative exposure to generate these characteristic curves.

The speed (CR) of a radiographic material is inversely related to the exposure required to produce a given effect. In these examples, speed of a radiographic film is determined by the exposure required to produce a density of 1.00 above the base plus fog of the film. Base plus fog is the optical density of the film plus the density of the emulsion layers in areas that have not been intentionally exposed. Gross fog (GF) is defined as film density arising from factors other than radiation used for imaging.

Film contrast is related to the slope or steepness of the characteristic curve. In these examples, film contrast (CT) is calculated from the slope of the characteristic curve between densities of 2.00 and 0.25 above the base plus fog density. Dmax (UDP)is a measure of the highest optical density for an exposed and processed film strip.

Lower scale contrast (LSC) is calculated from the slope of the characteristic curve between a density of 0.85 above base plus fog density and –0.03 log E.

Upper scale contrast (USC) is calculated from the slope of the characteristic curve between densities of 2.85 and 1.50 above the base plus fog density.

Example 1 development accelerator is:

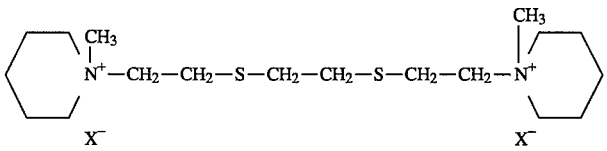

$X^-$ = tosylate

Example 2 development accelerator is:

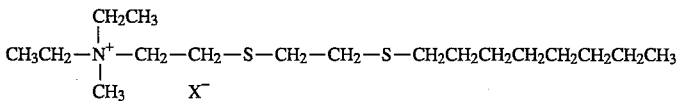

wherein X=tosylate ion.

Example 3 was a comparison structure that underlines the unobviousness in the present invention. The comparison structure is:

$$HO-CH_2-CH_2-S-CH_2-CH_2-S-CH_2-CH_2-OH \quad (2)$$

(3, 6-Dithia-1, 8-octanediol)

Accelerator examples outlined were tested in above developer composition with representative samples of radiographic films listed below in Table II. Sensitometric results are compared to aim sensitometry for the films tested. Aim sensitometry was determined by processing the films using standard processing chemistry in a standard processing cycle (i.e. RPX-OMAT developer in a 90 second roller transport process).

TABLE II

Sensitometric effects of Accelerator Examples in above developer example.

| Condition Example | Film | GF | CR | CT | LSC | USC | UDP |
|---|---|---|---|---|---|---|---|
| aim | TMG/RA | 0.27 | 443 | 2.76 | 2.02 | 3.05 | 3.55 |
| Example I | TMG/RA | 0.25 | 442 | 2.93 | 2.12 | 3.12 | 3.59 |
| Example II | TMG/RA | 0.28 | 441 | 2.86 | 2.08 | 3.16 | 3.75 |
| Example III | TMG/RA | 0.24 | 434 | 3.04 | 2.12 | 3.24 | 3.79 |
| aim | TMC/RA | 0.25 | 439 | 1.82 | 1.43 | 2.23 | 3.37 |
| Example I | TMC/RA | 0.20 | 438 | 1.99 | 1.53 | 2.31 | 3.44 |
| Example II | TMC/RA | 0.25 | 439 | 1.93 | 1.49 | 2.24 | 3.52 |
| Example III | TMC/RA | 0.22 | 431 | 1.96 | 1.50 | 2.49 | 3.59 |
| aim | TMH/RA | 0.29 | 466 | 2.89 | 2.03 | 2.95 | 3.51 |
| Example I | TMH/RA | 0.25 | 465 | 3.07 | 2.21 | 2.88 | 3.50 |
| Example II | TMH/RA | 0.29 | 463 | 3.09 | 2.18 | 3.27 | 3.68 |
| Example III | TMH/RA | 0.26 | 457 | 3.25 | 2.25 | 3.07 | 3.72 |
| aim | TML/RA | 0.22 | 433 | 2.21 | 1.85 | 1.93 | 3.16 |
| Example I | TML/RA | 0.20 | 432 | 2.32 | 1.93 | 1.98 | 3.17 |
| Example II | TML/RA | 0.22 | 431 | 2.32 | 1.93 | 2.14 | 3.30 |
| Example III | TML/RA | 0.21 | 426 | 2.34 | 1.90 | 2.12 | 3.39 |
| aim | TMS/RA | 0.21 | 441 | 2.46 | 1.99 | 1.48 | 3.01 |
| Example I | TMS/RA | 0.19 | 440 | 2.62 | 2.13 | 1.65 | 3.02 |
| Example II | TMS/RA | 0.22 | 440 | 2.61 | 2.08 | 1.95 | 3.17 |
| Example III | TMS/RA | 0.20 | 443 | 2.71 | 2.10 | 1.77 | 3.21 |
| aim | EB/RA | 0.24 | 408 | 2.33 | 1.84 | 2.58 | 3.63 |
| Example I | EB/RA | 0.23 | 419 | 2.53 | 2.08 | 2.28 | 3.45 |
| Example II | EB/RA | 0.27 | 416 | 2.33 | 1.89 | 2.56 | 3.82 |
| Example III | EB/RA | 0.22 | 404 | 2.50 | 1.95 | 2.46 | 3.63 |

The benefits observed from the use of development accelerators in these formulations arise from development accelerators (1) and (2) according to the invention. These accelerators have at least one quaternary ammonium functional group bonded to a thioether component. By employing these accelerators in developers containing an ascorbic acid developing agent it was possible to obtain sensitometry comparable to aim sensitometry obtained with a conventional hydroquinone-based developer. For these forehardened films, designed to be processed in rapid processing conditions such as Kodak's kwik process, adequate speed, contrast and Dmax was obtained when these developers were employed. There was no increase in speed with similar structure (3) having a sulfide linkage but not a quaternary ammonium functional group.

The invention has been described in detail with particular reference to preferred embodiments thereof, but it will be understood that variations and modifications can be effected within the spirit and scope of the invention.

We claim:

1. An alkaline, hydroquinone free, aqueous black-and-white radiographic developer comprising (a) an ascorbic acid developing agent;

(b) a 3-pyrazolidone auxiliary developing agent;

(c) an organic antifoggant;

(d) a sulfite antioxidant;

(e) a buffer;

(f) a sequestering agent; and (g) A development accelerator selected from formulas I and II as follows:

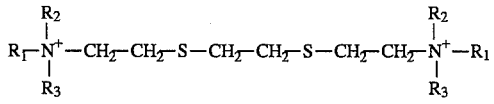

(I)

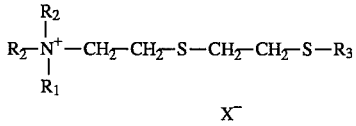

(II)

wherein $R_1$, $R_2$, and $R_3$ represent alkyl of 1 to 8 carbon atoms or $R_1$, $R_2$, and $R_3$ taken together with N atom to which they are attached form a 6 or 7 membered ring and X represents a tosylate ion, halide, or $BF_4^-$.

2. The developer of claim 1 wherein the development accelerator is

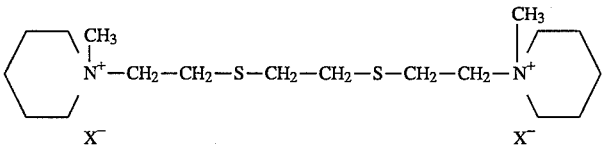

and $X^-$ represents tosylate.

3. The developer of claim 1 wherein the development accelerator is

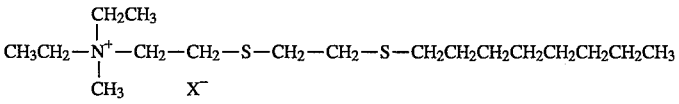

wherein X represents a tosylate ion.

4. The developer of claim 1, 2 or 3 wherein the ascorbic acid developing agent is selected from the group consisting of L-ascorbic acid, D-ascorbic acid, L-erythroascorbic acid, D-glucoascorbic acid, 6-desoxy-L-ascorbic acid, L-rhamnoascorbic acid, D-glucoheptoascorbic acid, D-glucoheptoascorbic acid, imino-L-erythroascorbic acid, imino-D-glucoascorbic acid, imino-6-desoxy-L-ascorbic acid, imino-D-glucoheptoascorbic acid, sodium isoascorbate, L-glycoascorbic acid, D-galactoascorbic acid, L-araboascorbic acid, sorboascorbic acid, sodium ascorbate and the like.

5. The developer of claim 1, 2 or 3 wherein the developing agent is ascorbic acid.

6. The developer of claim 5 wherein having a pH from 9 to 11.

7. The developer of claim 5 wherein the organic antifoggant is selected from the group consisting of 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4 -thiadiazol-2-yl-thio)butanesulfonate, 5-amino-1,3,4-thiadiazole-2-thiol, 5-methylbenzotriazole, 1-phenyl-5-mercaptotetrazole, and benztriazole.

8. The developer of claim 5 wherein the auxiliary developing agent is selected from the group consisting of 4-hydroxylmethyl-4-methyl-1-phenyl-3-pyrazolidinone, 1-phenyl-3-pyrazolidinone, 1-phenyl-4 -phenyl-3-pyrazolidinone, 1-phenyl-4,4-dimethyl-3-pyrazolidinone, 1-phenyl-4-methyl-3-pyrazolidinone, 1 -phenyl-5-methyl-3-pyrazolidinone, 4-methyl-1-phenyl-3-pyrazolidinone, 4,4'-dimethyl-1-phenyl-3-pyrazolidinone, o-aminophenol, p-aminophenol, N-methyl-p-aminophenol, N-methyl-o-aminophenol, and 2,4-diaminophenol.

9. The developer of claim 5 wherein said sulfite antioxidant is selected from the group consisting of sulfites, bisulfites, metabisulfites, and aldehyde-bisulfite adducts.

10. The developer of claim 2 or 3 further comprising ascorbic acid, potassium sulfite, potassium carbonate, 4-hydroxymethyl-4-methyl-1-phenyl-3-pyrazolidinone, 1-phenyl-5-mercaptotetrazole, benzotriazole, diethylenetriaminepetaacetic acid and potassium bromide.

11. The developer of claim 1, 2 or 3 comprising from 0.01 to 0.40 weight percent of the development accelerator and from 0.8 to 4 weight percent ascorbic acid developing agent.

12. A method for developing exposed silver halide photographic material, said method comprising developing said photographic material with an alkaline, aqueous radiographic developer according to claim 1.

* * * * *